US006513189B1

(12) United States Patent
Berry

(10) Patent No.: US 6,513,189 B1
(45) Date of Patent: Feb. 4, 2003

(54) WET ATTACHMENT APPARATUS FOR VACUUM CLEANERS

(76) Inventor: Robert J. Berry, 14 Friar Rd., Morris Plains, NJ (US) 07950

( * ) Notice: Subject to any disclaimer, the term of this patent is extended or adjusted under 35 U.S.C. 154(b) by 38 days.

(21) Appl. No.: 09/617,828

(22) Filed: Jul. 17, 2000

(51) Int. Cl.[7] ..... A47L 9/02
(52) U.S. Cl. ..... 15/353; 15/421
(58) Field of Search ..... 15/353, 421

(56) References Cited

U.S. PATENT DOCUMENTS

| | | | | | |
|---|---|---|---|---|---|
| 2,476,425 | A | * | 7/1949 | McLeary | 15/421 |
| 3,039,463 | A | * | 6/1962 | Dickey, Jr. et al. | 15/421 |
| 3,490,208 | A | * | 1/1970 | Meyer et al. | 15/353 |
| 4,041,569 | A | * | 8/1977 | Petersen | 15/353 |
| 4,179,769 | A | * | 12/1979 | Lundquist | 15/353 |
| 4,341,540 | A | * | 7/1982 | Howerin | 15/353 |
| 4,826,514 | A | * | 5/1989 | Griffis | 15/353 |
| 5,032,184 | A | * | 7/1991 | Ogilvie et al. | 15/353 |
| 5,377,383 | A | * | 1/1995 | Christensen | 15/353 |
| 5,985,009 | A | * | 11/1999 | Marsala | 15/353 |

* cited by examiner

*Primary Examiner*—Theresa T. Snider
(74) *Attorney, Agent, or Firm*—Thomas L. Adams

(57) ABSTRACT

An inlet hose feeds a tank that may be placed in a household sink which is too high above a floor for a conventional wet vacuum to lift a column of water. One or more inlet hoses each have a water pickup tube at the distal end. The hoses are connected to the tank chamber which has a vacuum created by a vacuum cleaner apparatus. An air inlet aperture in the pickup tube at the distal end of the inlet hose is kept above the water level. An air stream is drawn into the aperture of the pickup tube by the vacuum, which causes turbulence in the water stream in the pick up tube and breaks the water into droplets. This enables the vacuum of a given magnitude to lift the droplets to a higher elevation than a solid water column. Air inlet and water discharge valves are provided on the tank to control the water fill rate into the tank. An interior hose or channel stops the vacuum to the pickup hose when the fluid in the tank gets too high. A window in the tank permits observation of the fill rate. The valves are arranged to provide optimum water fill and discharge rates.

35 Claims, 4 Drawing Sheets

FIG. 1
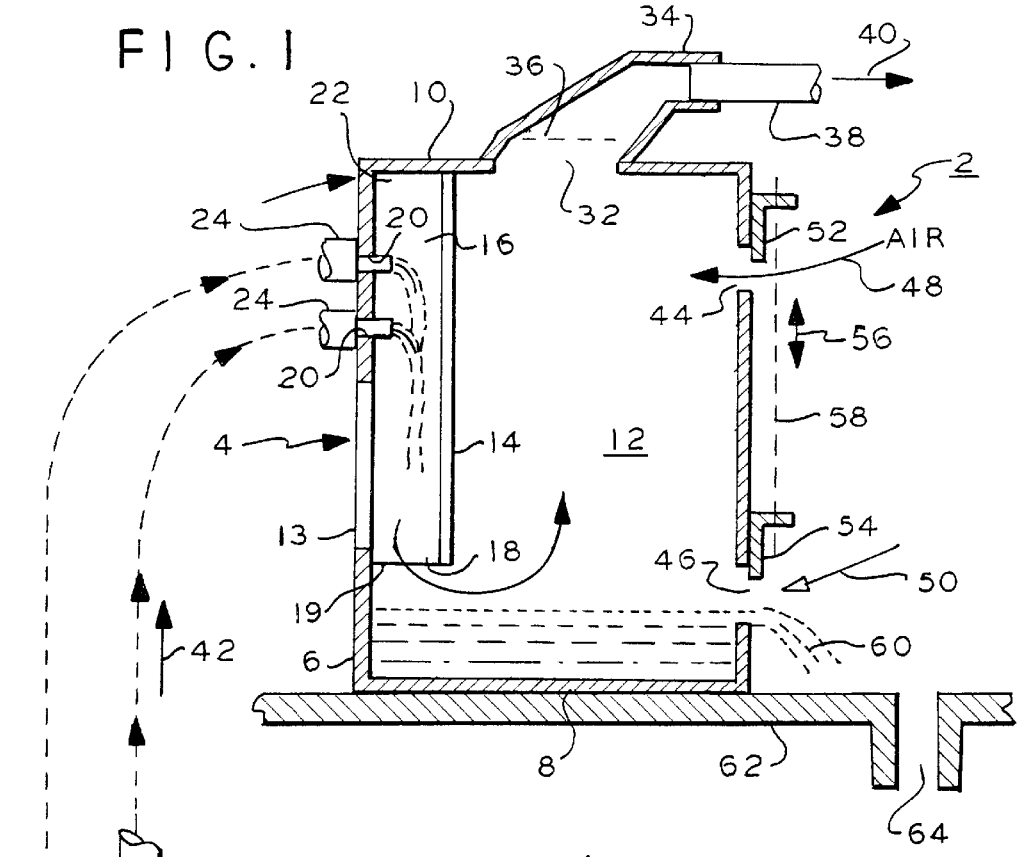
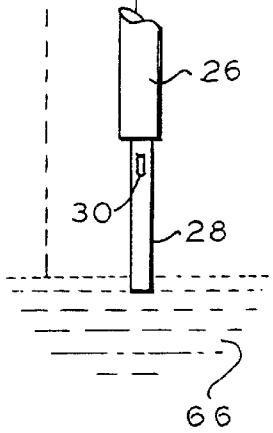
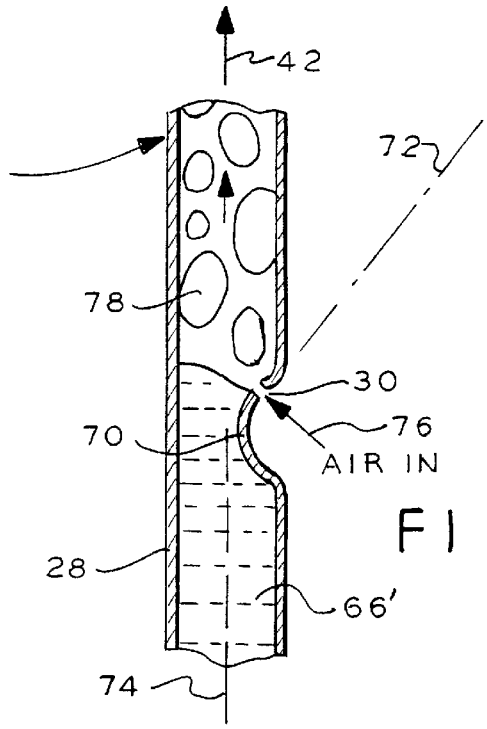
FIG. 2

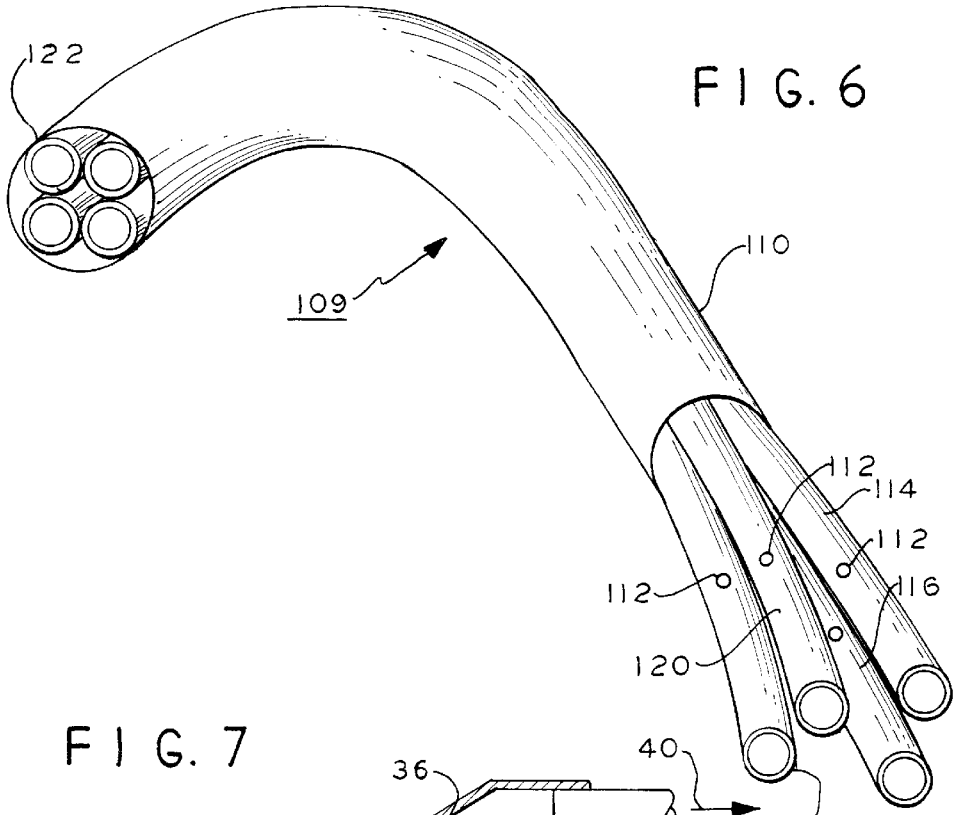
FIG. 6
FIG. 7
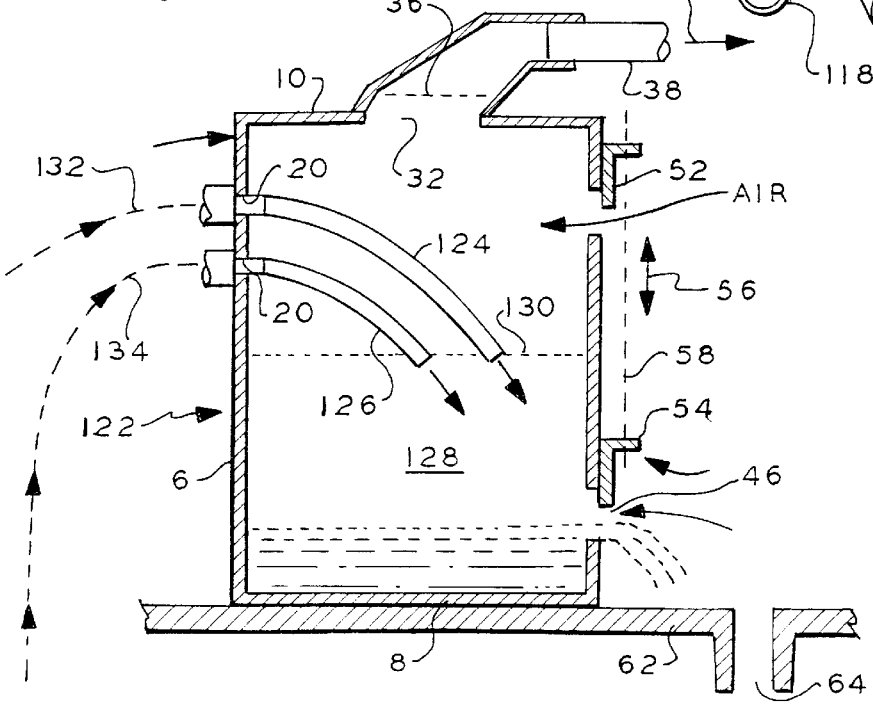

WET ATTACHMENT APPARATUS FOR VACUUM CLEANERS

BACKGROUND OF THE INVENTION

1. Field of the Invention

The present invention relates to vacuum apparatus for removing water or other liquids from a space, and, more particularly, to apparatus for lifting volumes of liquid with vacuum apparatus.

2. Description of Related Art

Most conventional vacuum cleaner machines can not lift water or other heavy liquids to typically above 29 to 30 inches above the liquid level being withdrawn. This is a problem with most households having such conventional machines. Most households have sinks or basins for receiving and draining water at about 35 inches or more above floor level. Such conventional cleaners include shop vacuums sometimes referred to as wet/dry vacuum machines, which are designed for use in shops, garages and basements and so on for vacuuming water off a floor. Water weighs about 8.34 lb/gal (1 kg/l). A wet shop vacuum machine typically may have a 5 gallon (21 l) capacity. When filled with water the water weighs 41.7 lb (19 kg) which is heavy for an average home maker to lift into a sink for emptying the contents without spilling.

In U.S. Pat. No. 5,263,224 a portable vacuum cleaner attachment is disclosed which attaches to an end of a vacuum cleaner hose to remove and separate liquid, so the liquid does not enter the vacuum unit. Attached to the unit is a tank that stores liquid to be removed. A first inlet receives the vacuum and a second inlet receives the liquid at a nozzle. A deflector deflects the incoming liquid into the tank from the vacuum exhaust inlet inside the tank which vacuum sucks the liquid into the nozzle. This patent does not address the problem of using conventional wet vacuums and the heavy water load therein. The tank in this patent cannot be too large or else it presents the same problem of lifting a heavy liquid load. Thus this apparatus can only deal with small liquid volumes. Vents are provided to allow air flow into the vacuum unit.

In U.S. Pat. Nos. 5,974,624 and 5,377,383 disclose a similar device with a passage that directs the stream along a path. They disclose a tank adjacent to the inlet nozzle which limits the volume of water that can be picked up. Neither patent discloses an apparatus that lifts water or other liquids in relatively long columns above the water level being removed.

In U.S. Pat. No. 5,815,881 discloses a universal vacuum cleaner and a relatively large tank that rolls on wheels over a floor. Lifting the full tank to empty it would be difficult. This system uses a cyclonic separator. This patent does not disclose lifting liquids in relatively long columns above the water lever being removed.

U.S. Pat. No. 5,985,009 discloses a carpet cleaning waste water disposal apparatus.

The present inventor recognizes a need for an apparatus that can be used with conventional vacuum machines and can be used to lift liquids at greater height columns than heretobefore known with conventional vacuum cleaners.

SUMMARY OF THE INVENTION

In accordance with the illustrative embodiments demonstrating features and advantages of the present invention, there is provided a wet attachment for a vacuum cleaner having a vacuum inlet. The attachment includes a fluid tank having a first chamber for receiving fluid in a fluid inlet. The tank has a vacuum inlet arranged to be attached to the vacuum inlet to apply a vacuum to the chamber. The attachment also includes at least one elongated fluid inlet conduit having a first end coupled to the tank fluid inlet and a second end for immersion in fluid to be conveyed to the chamber in response to the vacuum applied to the chamber. The conduit has an air inlet spaced from the first end medially the first and second end. The air inlet is responsive to the vacuum in the conduit from the chamber for drawing ambient atmosphere air into the conduit and for injecting the drawn ambient air into the conveyed fluid to form an assemblage wherein the air and fluid are spatially segregated into separate regions.

In accordance with another aspect of the invention an attachment is provided for a wet vacuum cleaner having a tank with a first chamber for applying a vacuum to and receiving fluid from a fluid inlet. The attachment includes at least one elongated fluid inlet conduit having a first end coupled to the tank fluid inlet and a second end for immersion in fluid to be conveyed to the chamber in response to the vacuum applied to the fluid inlet. The conduit has an air inlet spaced from the first end medially the first and second ends. The air inlet is responsive to the vacuum in the conduit from the fluid inlet for drawing ambient atmosphere air into the conduit and for injecting the drawn ambient air into the conveyed fluid to form an assemblage wherein the air and fluid are spatially segregated into separate regions.

In one embodiment, the at least one conduit is a tube with a longitudinal axis and a concave depression and the air inlet comprises an aperture in the depression lying in a plane inclined toward the longitudinal axis and toward the tank end of the at least one conduit.

In a further embodiment, the at least one conduit comprises an annular wall, the air inlet is an aperture in the wall, further including a shield attached to the at least one conduit in spaced relation to the wall forming a second chamber there between, the shield having opposing third and fourth ends on opposite sides of the air inlet with the third shield end being attached to the at least one conduit in a region between the air inlet and the at least one conduit second end so that the second chamber is water impervious between the at least one conduit second end and the shield third end.

In a further embodiment, the air inlet is a hole in the at least one conduit. In a further embodiment, the tank has a bottom wall and an annular side wall and at least one tube connected to the fluid inlet and extending medially the fluid inlet and bottom wall to limit the volume of fluid that can enter the first chamber.

In a further embodiment, the tank has a top wall, a bottom wall and an annular side wall forming the first chamber, the tank including an interior wall in the first chamber forming a channel with the side wall, the channel being in fluid communication with the fluid inlet, the channel extending toward the bottom wall to limit the volume of fluid that can enter the first chamber.

In still other embodiments the far end of the conduit can be totally immersed in the fluid because an air inlet in the conduit is spaced a significant distance from the immersing fluid. Furthermore, the tank has means for limiting the fluid drawn into the tank to a predetermined level.

A window may be in the tank side wall for observing the amount of fluid in the tank

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 1 is an elevation sectional view of an apparatus according to an embodiment of the present invention;

FIG. 2 is a more detailed, fragmented, sectional, and elevational view of the inlet conduit and tube of the apparatus of FIG. 1;

FIG. 6 is a fragmented view of further embodiments of the inlet conduit for use with the apparatus of the present invention;

FIG. 7 is an elevational, sectional view of an apparatus according to a further embodiment of the present invention;

DETAILED DESCRIPTION OF THE PREFERRED EMBODIMENTS

Figure 3:
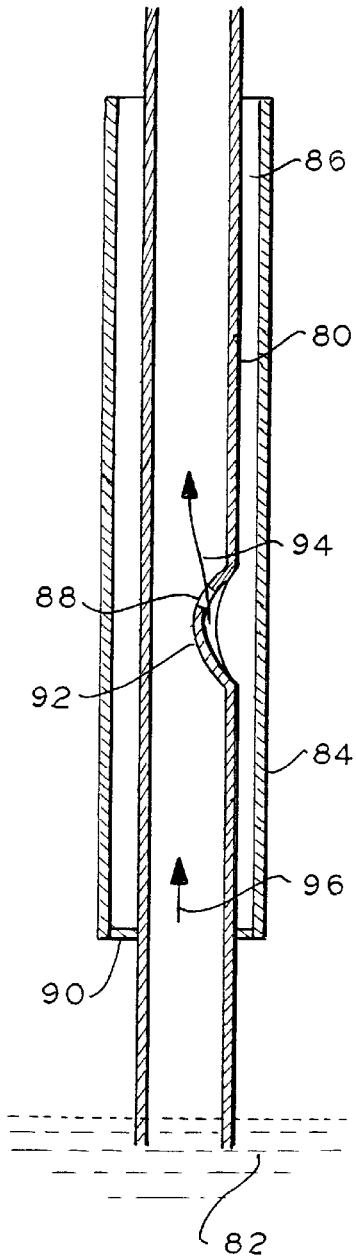
FIGS. 3, 4 and 5 are views similar to the view of FIG. 2 showing different embodiments.

Referring to FIG. 1, wet attachment apparatus 2 for vacuum cleaners comprises a tank 4 having a circular cylindrical side wall 6, a bottom wall 8, and a top wall 10. The tank has an interior chamber 12. Inside the chamber 12 is a wall 14 which may extend across the chamber 12 or may be semi-circular pipe forming a channel 16. The wall 14 depends from the top wall 10 or, in the alternative, may depend from a further top wall (not shown) inside the chamber. The channel 16 is open at the bottom 18 in a direction toward bottom wall 8.

The side wall 6 has two openings 20. The openings are near the channel closed top 22 or may be at the top of the channel 16. Two hoses 24 are secured in the openings 20, one hose in each opening. It will be appreciated that other embodiments may use a different number of hoses, including the use of just a single hose, The hoses 20 may be any conventional fluid hose as known in this art, and preferably are flexible, but may also be rigid plastic tubes, as also known in this art. The hoses terminate at distal ends 26.

A tube 28, preferably having a ½ inch (1.3 cm) internal diameter, is attached to end 26 of each hose, one tube being shown. The tube 28 may have other diameters according to a given implementation as will be described. Tube 28 may be made of copper, plastic, or other materials. An aperture 30 is in tube 28 in fluid communication with the tube's hollow internal core.

An opening 32 is in the tank top wall 10. A vacuum cleaner inlet nozzle 34 is attached to the top wall 10 coupled to the opening 32. An optional fluid deflector screen 36 may be in the opening 32 near the top wall 10. A conventional vacuum cleaner hose 38 is attached to the nozzle 34 for applying a vacuum to the chamber 12. The hose 38 draws air from the interior of the tank in chamber 12 in direction 40. This causes air to flow through the hoses 24 into the chamber 12 in direction 42 through the openings 20. The deflector screen 36 prevents water or other fluids drawn into the chamber 12 from being drawn out of the chamber 12 into the vacuum cleaner hose 38 attached to the nozzle 34.

The tank 4 side wall 6 has two openings 44 and 46 on a side of wall 6 opposite the fluid inlet openings 20, hoses 24 and channel 16. Opening 44 is near the top wall 10 and is a vent for letting air flow into the chamber 12 in direction 48. Opening 46 is near or at the bottom wall 8 to drain fluid, e.g., water or any liquid, stored in the tank. The side wall 6 has a clear window 13 to permit observation of the fluid volume in the tank 4 and to adjust the parameters of the fluid and air flows accordingly. A slide valve 52 selectively opens and closes the opening 44 to selected different aperture sizes to control the vacuum level in the chamber 12.

A slide valve 54 is connected to the side wall 6 for selectively opening and closing the drain opening 46. The valves 52 and 54 move in directions 56. Preferably the slide valves 52 and 54 are interconnected by a link 58 represented by a dashed line to show it is optional. In this way both openings 44 and 46 are opened and closed simultaneously to selectively control the amount of air admitted to the chamber 12 while also controlling the flow of fluid 60 out of the chamber 12.

The valves are cracked open slightly and gradually as the fluid volume in the tank 4 is being observed in the window 13. The valves are adjusted to maximize unattended water flow. The drain valve 54 is important because it permits the fluid to drain out of the chamber 12 while valve 52 controls the air flow into the chamber 12 at the same time. Negative pressure is required in the chamber 12 in order to draw the fluid into the chamber before flowing out of drain opening 46.

If the valve 54 opening 46 is too small, little drainage occurs and the fluid level in the tank rises, theoretically choking openings 20, which then stop supplying fluid for reasons to be described presently. If the valve 52 opening 44 is too small, then little air bleeding occurs and a high vacuum exists, which also draws excessive fluid from openings 20 and again causes a high fluid level in the tank chamber 12. On the other hand, if valves 52 and 54 are both opened too wide, excessive air will bleed into chamber 12 along the directions 48 and 50, thereby reducing the negative pressure in tank chamber 12 and producing little fluid flow through openings 20.

Accordingly, valves 52 and 54 should be adjusted to produce a favorable negative pressure in tank chamber 12. The proper amount the valves ought to be opened can be determined by watching the fluid fill level in the tank and the fluid volume draining from the tank 4 until there is a balance so the apparatus can be left unattended to remove the unwanted fluid 66. An operator will adjust the valves 52 and 54 to increase the outflow 60 until a stable flow occurs that does not cause the fluid level in tank chamber 12 to rise excessively.

By tying both valves to operate together, an optimum point is reached for both valves in which fluid dumping and air in is balanced to obtain a balance fluid flow into and out of the tank 4. A level float device (not shown) may be provided in chamber 12 to shut off the flow of fluid into the chamber 12 if the fluid in the chamber is too high in place of the channel 18 of FIG. 1.

In operation, the hose 38 from the vacuum cleaner is connected as shown. The tank 4 is placed in a sink 62 or other convenient receptacle having a drain 64. The apparatus 2 thus is of a size to conveniently fit in most household sinks. The tube 28 for one or both hoses 24 is placed in and immersed with the tip fully submerged into the fluid 66 to be removed by apparatus 2. The fluid 66 may be water or other liquid on a floor, in a clogged sink, a basement sump or elsewhere where ever fluid may collect undesirably.

The hoses 24 are sufficiently long to reach the desired location of the fluid 66 with the apparatus placed in a drain sink 62. The sink 62 may be typically 35 inches above a floor, for example, of a basement from which the fluid is to be removed. Normally, filling and lifting a 5 gallon tank to the sink 62 of prior art shop vacuums to empty their tanks would be difficult due to the excess weight of the fluid, e.g., water. In this case, the light empty tank 4, which may be molded thermoplastic and thus relatively light, is easily lifted and placed in the sink prior to starting the removal of fluid 66.

The aperture 30 is spaced sufficiently from the end of the tube 28 being immersed so that no fluid 66 is near the aperture. Fluid over the aperture would defeat the purpose of the operation of apparatus 2. Preferably, the aperture 30 is spaced from the end of tube 28 about 20 inches (0.5 m) or less., if low fluid levels are expected. This is to ensure vertical lift of the fluid without immersion of aperture 30 as fluid is drawn into the hoses 24 and tank 4. The hoses 24 are preferably about 3 to 5 feet (0.9 to 1.5 m) in length. The tubes 28 are preferably vertical to ensure no fluid blocks the aperture 30 during use. A snorkel hose (such as hose 108, FIG. 4) can be coupled to the aperture 30. The upper end of the snorkel hose will remain above the level of fluid 66 so that aperture 30 will not be blocked.

With the vacuum cleaner turned on, the vacuum is applied to the chamber 12 and to the hoses 24 and tubes 28. This draws the fluid 66 into the tubes 28 and hoses 24. In FIG. 2, the tube 28 has a depression 70 or dimple. This depression may be preferably semi-spherical. In other embodiments, the depression may be frustro-conical, elipsoidal, prismatic, or have other shapes. In still other embodiments, a short circumferential incision may be made in the wall of tube 28, and the wall can be pressed in only on the upstream side of the incision to create an opening facing in the downstream direction (that is, a configuration similar to that used in simple pipe whistles). In yet other embodiments, the wall of tube 28 will not be deformed with a concavity, but will be pierced by a channel that is preferably (but not necessarily) inclined toward the downstream direction.

The aperture 30 is in the depression 70. The aperture is in a wall of the depression 70 that lies in a plane 72 that is inclined to the longitudinal axis 74 of the tube 28. This causes the air 76 flowing into the tube 28 through the aperture 30 to be inclined in a downstream direction toward the direction 42 of fluid flow along the axis 74. In some embodiments the orientation of the aperture may be inclined toward a downstream direction without employing a concave depression or otherwise deforming tube 28. For example, a short tubule (not shown) may be installed obliquely through the wall of tube 28. Alternatively, a small amount of filling material (not shown) may be secured on an inside face of tube 28 before drilling a hole at an angle through the tube 28 and filling. In still other embodiments, tube 28 may have an aperture in a flared transition (not shown) where the inside diameter increases, thereby creating an opening inclined toward the downstream direction.

The air is drawn into the tubes 28 apertures 30 by the low pressure vacuum in the tube communicated from the chamber 12 and vacuum cleaner via hose 38. The low pressure vacuum causes the fluid 66 to flow into the tube at 66' (FIG. 2) in direction 42. The air stream 76 through the aperture 30 impinges upon the fluid 66' stream and creates turbulence, breaking the liquid up into an assemblage wherein the air and fluid are spatially segregated into separate regions. In some embodiments the fluid will be broken up into separate droplets 78. The size of the droplets 78 will depend on the speed and volume of incoming air. With sufficiently energetic incoming air, the liquid can be atomized. These droplets form a somewhat atomized unit volume that is a fluid and air mixture and, thus, is lighter per unit volume than the fluid, e.g., water, alone. In still other embodiments, the injected air can create bubbles or a froth from the fluid. In some regions the fluid may form a film that is driven up the inside surface of the tube by the moving air. As a result of one or more of these mechanisms, the column of mixed air-fluid or water is lighter than a similar length of only the fluid or water column.

This lighter air-fluid mixture column can be lifted higher by a given vacuum level than only a corresponding fluid, i.e., water column. Also, since the air-fluid or water mixture is lighter, it also moves faster than the heavier fluid, i.e., water, for a given vertical force imposed by the vacuum. In part, the air stream quickly flows around the slower moving liquid droplets, causing a dynamic pressure that urges the droplets up to the hose end 24. This mechanism is dominant for droplets clinging to the inside wall of tube 28 or hose 26. For relatively small droplets, these may become detached from the inside wall and entrained in the air stream and move at or near the speed as the air, depending upon droplet size. Thus the generally low power conventional shop vacuum cleaners and household vacuum cleaners can lift the fluid-air mixture column directly into the sink via the tank 4.

It can be shown that for ⅝th inch (1.6 cm) hose 26 and a ½ inch (1.3 cm) ID tube 28 with a ⅛th inch (0.3 cm) aperture 30, water can be removed to a sink elevated at 35 inches (0.9 m) above fluid 66 into the tank 4 and drained therefrom at a rate of 60 gallons (54.5 l) per hour and as much as 90 (82 l) gallons per hour. An arrangement using a four hose-tube combination (e.g. FIG. 6) can pump 240 gallons (218 l) of water an hour at a height of 40 inches (1.0 m). Also pumping of 360 gallons (327 l) an hour is possible. Opening the valve 52 fully lets a high volume of air into the chamber 12, shutting down the vacuum and stopping the fluid withdrawal operation.

The channel 16 (FIG. 1) at its lower edge 19 limits the amount of fluid that flows into the tank. Once the fluid reaches edge 19, the vacuum at the openings 20 is interrupted and the fluid removal stops. This effectively produces a self-regulating feature for preventing an excessively high liquid level.

In FIG. 3, metal tube 80 is immersed in fluid 82, i.e., water. The tube has an outer jacket 84 which is tubular and encloses a portion of tube 80, forming a shield about the tube 80. The jacket 84 forms a chamber 86 around the tube 80. The tube 80 has in the chamber 86 an air inlet aperture 88 in the semi-spherical depression 92. As before, aperture 88 is positioned to direct the air stream through the aperture 88 in direction 94 toward the tank and close to the same direction 96 of the fluid drawn into the tube 80. The chamber 86 is sealed closed at the bottom wall 90, which may be bonded, glued or welded to the inner tube 80 to form a water tight seal therewith. Chamber 86 is, however, open at the top to allow incoming air to flow through the chamber and into aperture 88. This mixes the fluid 82 with the air, creating turbulence and fluid, i.e., water, droplets as described above.

The size of the aperture 88 is a function of the amount of vacuum, the size of the tube 80 and the nature, i.e., viscosity, of the fluid so as to form the desired mixture. This is determined empirically for a given implementation.

Figure 4:
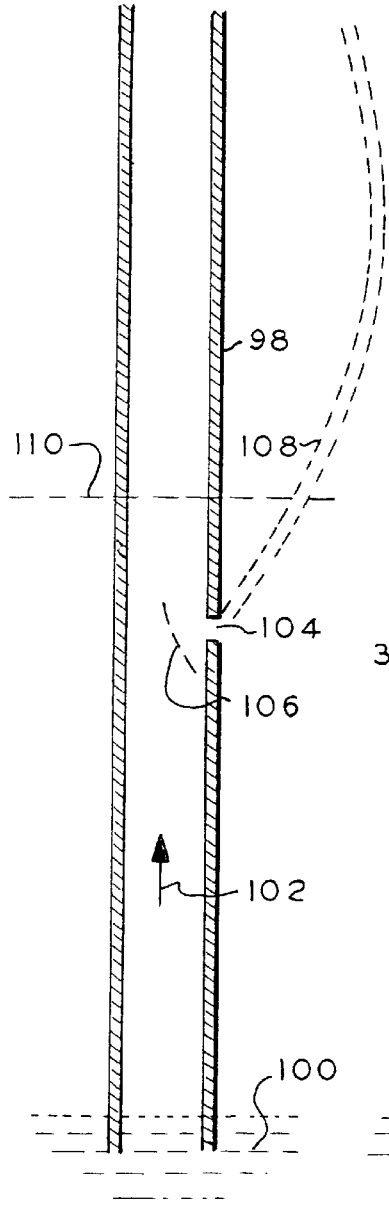

Referring to FIG. 4, tube 98 has an aperture 104, preferably 1/16 inch (1.6 mm) in diameter for a ½ inch (1.3 cm) ID tube 98, and optional deflector 106 (shown in phantom). Water 100 is drawn into the tube in direction 102. An optional hose 108 (shown in phantom) is connected air tight to aperture 104 to permit the tube and aperture to be immersed totally in the water 100 at level 110. No air can enter the aperture 104 so long as the distal end of hose 108 remains above water. This hose 108 permits the relatively long tube 98 to be immersed in relatively deep water and permits the aperture 104 to inject air for breaking up the water in the tube into droplets as desired.

Figure 5:
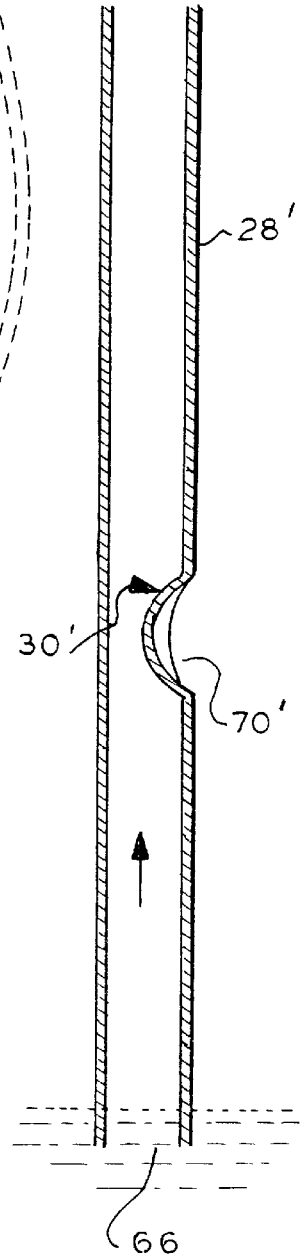

In FIG. 5, a length of tube 28' has a ½ inch (1.3 cm) ID and an aperture 30' of 1/16 inch (1.6 mm) in diameter. The aperture is in a semi-spherical depression 70'.

In FIG. 6, a hose 109 has an outer conduit jacket 110 containing four internal tubes 114–120. Each tube 114–120 has an air inlet aperture 112. Ends 122 of the tubes 114–120 are connected to the tank 4. This arrangement is for use with commercially available wet shop vacuum cleaners (not shown), which are being provided in smaller sizes. The ends 122 of the tubes 114–120 are fitted into the intake vacuum port of the wet vacuum cleaner. The valves of FIG. 1 may be added to this vacuum cleaner. No vacuum nozzle is needed as this machine is itself a vacuum chamber. This unit provides the desired withdrawal of fluid and can pump 240 gallons of water an hour. The hose 109 can also be used with the tank 4 of FIG. 1.

In FIG. 7, apparatus 122 is generally the same as apparatus 2 of FIG. 1, except hoses 124 and 126 (also referred to as tubular passages) are substituted for the channel 18 created by walls 14 and 16. Hoses 124 and 126 serve the same purpose as the channel 18 to limit the level of fluid in the chamber 128. When the fluid reaches the approximate level 130 at the tip of the free ends of the hoses 124 and 126, the vacuum to the hoses 132 and 134 ceases.

Figure 8:
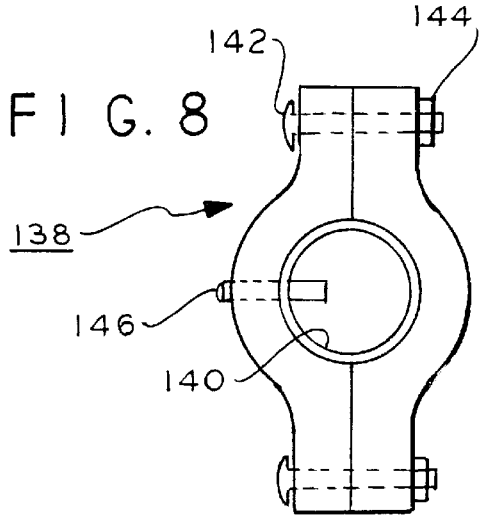
FIG. 8 is an end view of a clamp and portion of the inlet pipe of a further embodiment.
Figure 9:
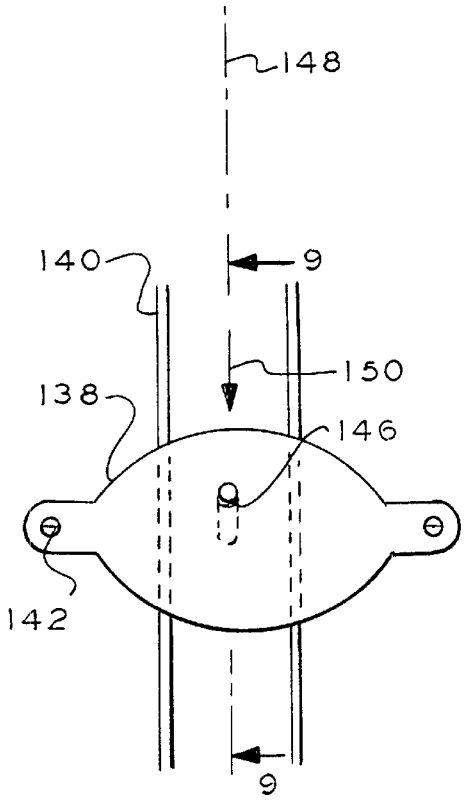
FIG. 9 is a top plan view of the clamp and portion of the inlet pipe of FIG. 8.
Figure 10:
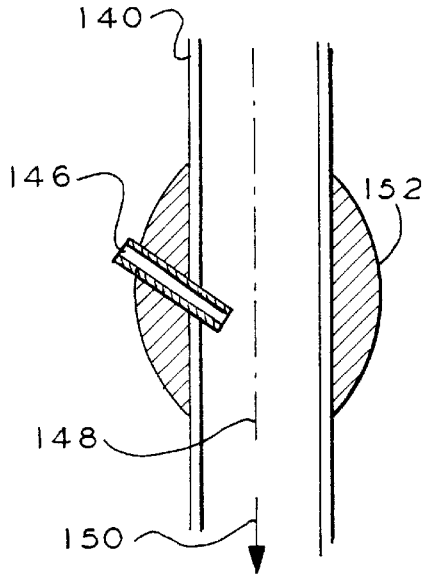
FIG. 10 is a side, elevational, sectional, and fragmented view of the embodiment of FIG. 9 taken along line 9—9.

In FIGS. 8, 9 and 10, a thermoplastic clamp 138 is fitted over tube 140, which may be an ordinary garden hose. Tube 140 is to be immersed in water that is to be removed. Tube 140 is connected to tank 4 as described previously. The clamp 138 is secured to the tube 140 by screws 142 and nuts 144. A tube 146 is embedded in the clamp 138 and pierces tube 140 to reach the interior of tube 140. Tube 146 acts as the air-water mixing inlet aperture. The tube 146 can terminate more centrally of the core of tube 140 to direct the inlet air directly into the stream of water flowing in the tube 140.

The air-water mixing tube 146 is inclined relative to the longitudinal axis 148 of the tube 140. The fluid is flowing in the tube 140 in direction 150. The inclined tube 146 assists in forcing the continued flow of fluid in the tube 140 and forms bubbles and droplets as described above.

It will occur to one of ordinary skill that various modifications may be made to the disclosed embodiments which are given by way of illustration and not limitation. For example, the illustrated tank may be part of a wet vacuum that does not employ the illustrated tank openings 44 and 46 and channel 14. The scope of the invention is as defined in the appended claims.

What is claimed is:

1. A wet attachment for a vacuum cleaner having a vacuum intake comprising:

a fluid tank having a first chamber for receiving fluid in a fluid inlet, the tank having a vacuum inlet arranged to be attached to said vacuum intake to apply a vacuum to said chamber; and at least one elongated fluid conduit having a longitudinal axis, a first end coupled to said fluid inlet and a second end for immersion in fluid to be conveyed to said chamber in response to the vacuum applied to said chamber, said conduit having an air inlet spaced from said first end medially said first and second ends, said air inlet being responsive to the vacuum in said conduit from the chamber for drawing ambient atmosphere air into said conduit and for injecting said drawn ambient air into said conveyed fluid to form an assemblage wherein the air and fluid are spatially segregated a into separate regions, said air inlet being oriented in a direction inclined toward the longitudinal axis and toward the first end of the at least one elongated fluid conduit.

2. The attachment of claim 1 wherein the tank has a fluid outlet for draining the received fluid from the chamber.

3. The attachment of claim 1 wherein the air inlet is a hole in the at least one elongated fluid conduit.

4. The attachment of claim 1 wherein the at least one elongated fluid conduit comprises:

a tube with a concave depression, the air inlet comprising an aperture in the depress ion lying in a plane inclined toward the longitudinal axis and toward the first end of the at least one elongated fluid conduit.

5. The attachment of claim 1 wherein the at least one elongated fluid conduit comprises an annular wall, the air inlet being an aperture in the wall, and further comprising:

a shield attached to the at least one elongated fluid conduit in spaced relation to the wall to form a second chamber there between, the shield having opposing third and fourth ends on opposite sides of the air inlet with the third end being attached to the at least one elongated fluid conduit in a region between the air inlet and the second end so that the second chamber is water impervious between the second end and the third end.

6. The attachment of claim 1 wherein the at least one elongated fluid conduit has a longitudinal axis, the first air inlet being disposed at an angle to the longitudinal axis in the direction toward the tank.

7. The attachment of claim 6 wherein the air inlet comprises a tube connected to the at least one elongated fluid conduit.

8. The attachment of claim 7 including a clamp secured about the at least one elongated fluid conduit, the tube being secured to the clamp.

9. The attachment of claim 1 wherein the at least one elongated fluid conduit is a tube, the air inlet comprises an aperture in the tube, further including an air deflector in the tube for directing air flow through the aperture in a direction toward the tank.

10. The attachment of claim 1 further including a further conduit having a proximal end connected to the elongated fluid inlet conduit at said air inlet and a distal end, the further conduit being operable to couple air at a higher elevation from the distal end to said air inlet.

11. The attachment of claim 1 wherein the at least one elongated fluid conduit comprises a plurality of conduits, each conduit of the plurality having an air inlet.

12. The attachment of claim 1 wherein the at least one elongated fluid conduit comprises a copper tube about at least<<inch (1.3 cm) in diameter and the air inlet is about 1/16–3/16 inch (1.6–4.8 mm) in diameter.

13. The attachment of claim 1 wherein the air inlet is spaced from the second end an amount sufficient for the second end to be totally immersed in said fluid while said air inlet is spaced from said fluid.

14. A wet attachment for a vacuum cleaner having a vacuum intake comprising:

a fluid tank having a first chamber for receiving fluid in a fluid inlet, the tank having a vacuum inlet arranged to be attached to said vacuum intake to apply a vacuum to said chamber; and at least one elongated fluid conduit having a longitudinal axis, a first end coupled to said fluid inlet and a second end for immersion in fluid to be conveyed to said chamber in response to the vacuum applied to said chamber, said conduit having an air inlet spaced from said first end medially said first and second ends, said air inlet being responsive to the vacuum in said conduit from the chamber for drawing ambient atmosphere air into said conduit and for injecting said drawn ambient air into said conveyed fluid to form an assemblage wherein the air and fluid are spatially segregated into separate regions, wherein the tank has a bottom wall and an annular side wall and at least one tubular passage connected to the fluid inlet and extending inwardly, medially the fluid inlet and bottom wall to limit the volume of fluid that can enter the first chamber.

15. A wet attachment for a vacuum cleaner having a vacuum intake comprising:

a fluid tank having a first chamber for receiving fluid in a fluid inlet, the tank having a vacuum inlet arranged to be attached to said vacuum intake to apply a vacuum to said chamber; and at least one elongated fluid conduit having a longitudinal axis, a first end coupled to said fluid inlet and a second end for immersion in fluid to be conveyed to said chamber in response to the vacuum applied to said chamber, said conduit having an air inlet spaced from said first end medially said first and second ends, said air inlet being responsive to the vacuum in said conduit from the chamber for drawing ambient atmosphere air into said conduit and for injecting said drawn ambient air into said conveyed fluid to form an assemblage wherein the air and fluid are spatially segregated into separate regions, wherein the tank has a top wall, a bottom wall and an annular side wall forming the first chamber, the tank including an interior wall in the first chamber forming a channel with the side wall, the channel being in fluid communication with the fluid inlet, the channel extending toward the bottom wall to limit the volume of fluid that can enter the first chamber.

16. A wet attachment for a vacuum cleaner having a vacuum intake comprising:

a fluid tank having a first chamber for receiving fluid in a fluid inlet, the tank having a vacuum inlet arranged to be attached to said vacuum intake to apply a vacuum to said chamber; and at least one elongated fluid conduit having a longitudinal axis, a first end coupled to said fluid inlet and a second end for immersion in fluid to be conveyed to said chamber in response to the vacuum applied to said chamber, said conduit having an air inlet spaced from said first end medially said first and second ends, said air inlet being responsive to the vacuum in said conduit from the chamber for drawing ambient atmosphere air into said conduit and for injecting said drawn ambient air into said conveyed fluid to form an assemblage wherein the air and fluid are spatially segregated into separate regions, wherein the tank has a side wall, a bottom wall, a top wall and a fluid outlet for draining the received fluid from the chamber, the side wall having said fluid outlet and further having a vent opening to permit ambient air to enter the first chamber.

17. The attachment of claim 16 including valve means for adjustably setting the size of the vent opening.

18. The attachment of claim 16 including valve means for adjustably setting the size of the vent opening and the size of the fluid outlet.

19. The attachment of claim 18 wherein the valve means includes means for adjustably setting the vent opening and fluid outlet simultaneously.

20. The attachment of claim 18 wherein the means for adjustably setting the size of the vent opening and fluid outlet comprises a slide valve coupled to the vent opening and fluid outlet for selectively adjusting the vent opening and fluid outlet in unison.

21. A wet attachment for a vacuum cleaner having a vacuum intake comprising:

a fluid tank having a first chamber for receiving fluid in a fluid inlet, the tank having a fluid outlet for draining the received fluid from the chamber, an air inlet vent and a vacuum inlet arranged to be attached to said vacuum intake to apply a vacuum to said chamber;

valve means for adjusting the openings of the air inlet vent and the fluid outlet;

at least one elongated fluid conduit having a first end coupled to said fluid inlet and a second end for total immersion in fluid to be conveyed to said chamber in response to the vacuum applied to said chamber, said conduit having an air inlet spaced from said first end medially said first and second ends and arranged for directing air flow in a direction toward said first end, said air inlet being responsive to the vacuum in said conduit from the chamber for drawing ambient atmosphere air into said conduit and for mixing said drawn ambient air with said conveyed fluid to form said conveyed fluid into droplets.

22. The attachment of claim 21 wherein the air inlet is spaced from the second end an amount sufficient for the second end to be totally immersed in said fluid while said air inlet is spaced from said fluid.

23. An attachment for a wet vacuum cleaner having a tank with a first chamber for applying a vacuum to and receiving fluid from a fluid inlet, comprising:

at least one elongated fluid conduit having a longitudinal axis, a first end coupled to said fluid inlet and a second end for immersion in fluid to be conveyed to said chamber in response to the vacuum applied to said fluid inlet, said conduit having an air inlet spaced from said first end medially said first and second ends, said air inlet being responsive to the vacuum in said conduit from the fluid inlet for drawing ambient atmosphere air into said conduit and for injecting said drawn ambient air into said conveyed fluid to form an assemblage wherein the air and fluid are spatially segregated into separate regions, said air inlet being oriented in a direction inclined toward the longitudinal axis and toward the first end of the at least one elongated fluid conduit.

24. The attachment of claim 23 wherein the air inlet is a hole in the at least one elongated fluid conduit.

25. The attachment of claim 23 wherein the at least one elongated fluid conduit comprises:

a tube with a concave depression, the air inlet comprising an aperture in the depression lying in a plane inclined toward the longitudinal axis and toward the first end of the at least one elongated fluid conduit.

26. The attachment of claim 23 wherein the at least one elongated fluid conduit comprises an annular wall, the air inlet being an aperture in the wall, and further comprising:

a shield attached to the at least one elongated fluid conduit in spaced relation to the wall to form a second chamber there between, the shield having opposing third and fourth ends on opposite sides of the air inlet with the third end being attached to the at least one elongated fluid conduit in a region between the air inlet and the second end so that the second chamber is water impervious between the second end and the third end.

27. The attachment of claim 23 wherein the at least one elongated fluid conduit has a longitudinal axis, the air inlet being disposed at an angle to the longitudinal axis in the direction toward the tank.

28. The attachment of claim 27 wherein the air inlet comprises a tube connected to the at least one elongated fluid conduit.

29. The attachment of claim 23 wherein the at least one elongated fluid conduit is a tube, the air inlet comprises an aperture in the tube, further including an air deflector in the tube for directing air flow through the aperture in a direction toward the tank.

30. The attachment of claim 23 further including a further conduit having a proximal end connected to the elongated fluid inlet conduit at said air inlet and a distal end, the further conduit being operable to couple air at a higher elevation from the distal end to said air inlet.

31. The attachment of claim 23 wherein the at least one elongated fluid conduit comprises a plurality of conduits, each conduit of the plurality having an air inlet.

32. The attachment of claim 23 wherein the air inlet is spaced from the second end an amount sufficient for the second end to be totally immersed in said fluid while said air inlet is spaced from said fluid.

33. An attachment for a wet vacuum cleaner having a tank with a first chamber for applying a vacuum to and receiving fluid from a fluid inlet, comprising:

at least one elongated fluid conduit having a first end coupled to said fluid inlet and a second end for immersion in fluid to be conveyed to said chamber in response to the vacuum applied to said fluid inlet, said conduit having an air inlet spaced from said first end medially said first and second ends, said air inlet being responsive to the vacuum in said conduit from the fluid inlet for drawing ambient atmosphere air into said conduit and for injecting said drawn ambient air into said conveyed fluid to form an assemblage wherein the air and fluid are spatially segregated into separate regions, wherein the tank has a bottom wall and an annular side wall and at least one tubular passage connected to the fluid inlet and extending inwardly, medially the fluid inlet and bottom wall to limit the volume of fluid that can enter the first chamber.

34. An attachment for a wet vacuum cleaner having a tank with a first chamber for applying a vacuum to and receiving fluid from a fluid inlet, comprising:

at least one elongated fluid conduit having a first end coupled to said fluid inlet and a second end for immersion in fluid to be conveyed to said chamber in response to the vacuum applied to said fluid inlet, said conduit having an air inlet spaced from said first end medially said first and second ends, said air inlet being responsive to the vacuum in said conduit from the fluid inlet for drawing ambient atmosphere air into said conduit and for injecting said drawn ambient air into said conveyed fluid to form an assemblage wherein the air and fluid are spatially segregated into separate regions, wherein the tank has a top wall, a bottom wall and an annular side wall forming the first chamber, the tank including an interior wall in the first chamber forming a channel with the side wall, the channel being in fluid communication with the fluid inlet, the channel extending toward the bottom wall to limit the volume of fluid that can enter the first chamber.

35. An attachment for a wet vacuum cleaner having a tank with a first chamber for applying a vacuum to and receiving fluid from a fluid inlet, comprising:

at least one elongated fluid conduit having a first end coupled to said fluid inlet and a second end for immersion in fluid to be conveyed to said chamber in response to the vacuum applied to said fluid inlet, said conduit having an air inlet spaced from said first end medially said first and second ends, said air inlet being responsive to the vacuum in said conduit from the fluid inlet for drawing ambient atmosphere air into said conduit and for injecting said drawn ambient air into said conveyed fluid to form an assemblage wherein the air and fluid are spatially segregated into separate regions, wherein the tank has a side wall, a bottom wall, a top wall and a fluid outlet for draining the received fluid from the chamber, the side wall having said fluid outlet and further having a vent opening to permit ambient air to enter the first chamber.

* * * * *